US006578950B2

(12) United States Patent
Matsumoto et al.

(10) Patent No.: US 6,578,950 B2
(45) Date of Patent: Jun. 17, 2003

(54) LINE HEAD AND IMAGE RECORDING METHOD

(75) Inventors: Nobuo Matsumoto, Kanagawa (JP); Seiichi Inoue, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/938,666

(22) Filed: Aug. 27, 2001

(65) Prior Publication Data

US 2002/0024557 A1 Feb. 28, 2002

(30) Foreign Application Priority Data

Aug. 28, 2000 (JP) ..... 2000-256894

(51) Int. Cl.[7] ..... B41J 2/155
(52) U.S. Cl. ..... 347/42
(58) Field of Search ..... 347/42, 13, 49

(56) References Cited

U.S. PATENT DOCUMENTS

| | | | | |
|---|---|---|---|---|
| 5,666,140 A | | 9/1997 | Mitani et al. | 347/12 |
| 6,027,203 A | * | 2/2000 | Campbell | 347/42 |
| 6,315,390 B1 | * | 11/2001 | Fujii et al. | 347/42 |

FOREIGN PATENT DOCUMENTS

| | | |
|---|---|---|
| JP | 48-9622 | 2/1973 |
| JP | 54-051837 | 4/1979 |
| JP | 58-063454 | 4/1983 |
| JP | 5-050601 | 3/1993 |
| JP | 6-297714 | 10/1994 |
| JP | 7-227967 | 8/1995 |
| JP | 8-020110 | 1/1996 |
| JP | 8-207291 | 8/1996 |
| JP | 10-016242 | 1/1998 |
| JP | 11-207956 | 8/1999 |

* cited by examiner

*Primary Examiner*—Thinh Nguyen
(74) *Attorney, Agent, or Firm*—Whitham, Curtis & Christofferson, P.C.

(57) ABSTRACT

A line head, includes a plurality of short heads, each of which has an array of recording elements arranged in one direction, disposed in the direction of arrangement, wherein the short heads that are adjacent to each other in the direction of arrangement are located at a different position in a direction normal to the direction of arrangement as well as an interval between a recording element of one of said two short heads and a recording element of the other short head, which two elements are adjacent to each other in said direction of arrangement, is set equal to or less than the proper arrangement pitch of the recording elements when viewed from the auxiliary scanning direction. Further, when an image is scanned and recorded using this line head, the driving of the recording elements are controlled according to the proper arrangement pitch of the recording elements and the interval as above in the joint region of two short heads adjacent to each other. With this arrangement, the short heads can easily be arranged and put into registration with each other, whereby a manufacturing process can be simplified, the line head can be fabricated at low cost, and further an image recording method capable of recording an image of high quality by means of this line head can be provided.

16 Claims, 9 Drawing Sheets

FIG. 2
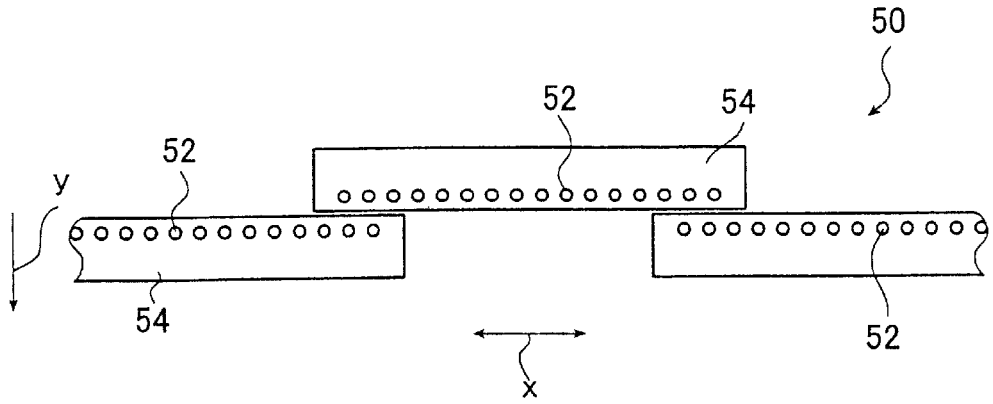
FIG. 3A
FIG. 3B
FIG. 3C
FIG. 3D
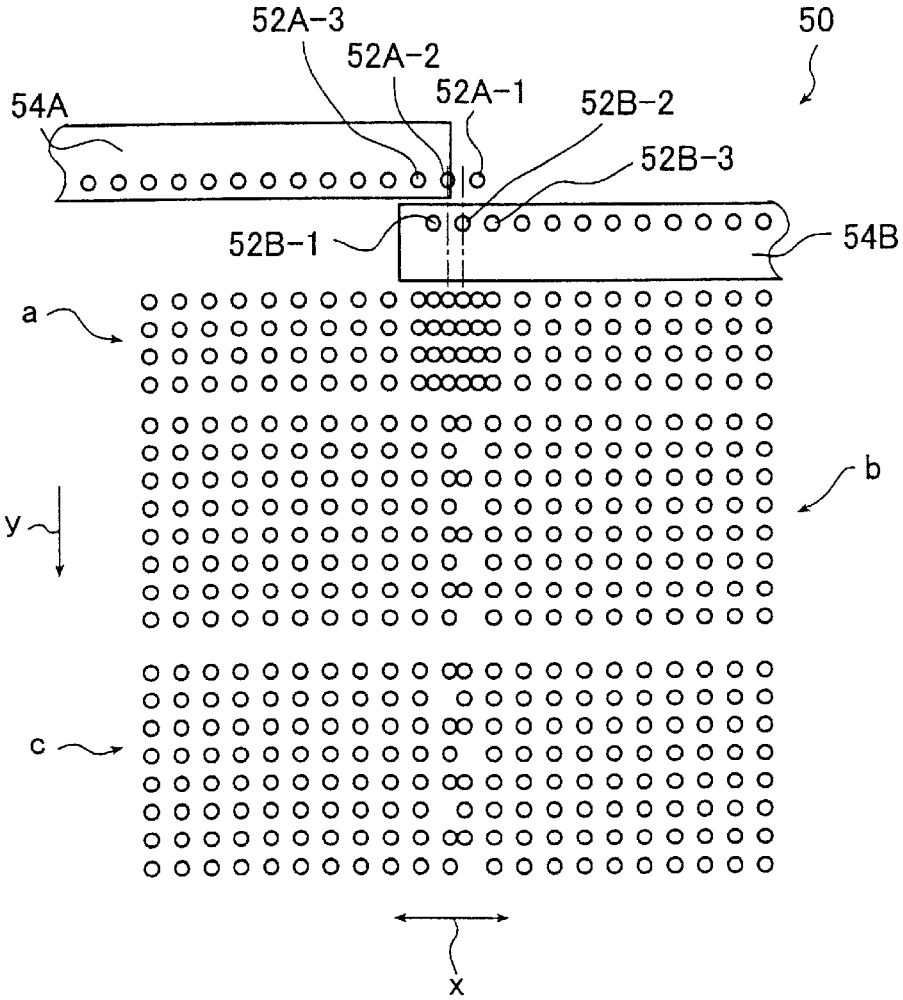

LINE HEAD AND IMAGE RECORDING METHOD

BACKGROUND 0O THE INVENTION

The present invention relates to the technology of image recording apparatus using a long line head. More particularly, the present invention relates to a line head that is composed of an array of short heads and can be manufactured easily at a low cost and to an image recording method capable of recording an image of high quality using this line head.

Unexamined Published Japanese Patent Application JP, 48-009622, A and JP, 54-051837, A teach inkjet recording apparatus of a type in which part of ink is rapidly evaporated by impulse heating so that the resulting force of expansion allows ink drops to be propelled from orifices.

JP, 05-050601, A and JP, 11-207956, A teach inkjet recording apparatus of another type in which a diaphragm is provided in an ink chamber and vibrated by static electricity, with a piezoelectric device or otherwise so that ink drops are propelled from nozzles. These and other types of inkjet recording apparatus have many advantages such as fairly low price, ease in handling and good image quality and hence are used extensively as printers in various applications.

In such inkjet printers and various other printers that employ a "recording head" as in thermal printers and dot impact printers, the recording head is usually a short one comprising an array of recording elements and the recording medium at rest is scanned by the recording head which is moved by a carriage in a direction which is approximatelly or substantially perpendicular to the direction of arrangement of the recording elements and when one scan cycle ends, the recording medium is moved in the direction of arrangement of the recording elements over the distance determined by the number of recording elements in the head and another scan is performed by the same procedure as described above; this process is repeated to record image on the entire surface of the recording medium.

Printers are also known that use a so-called "line head" which has recording elements arranged over a distance to cover the entire length of one side of the recording medium.

The major advantage of using the line head is that by merely performing relative movements (scanning) of the recording medium and the Line head in an auxiliary direction (auxiliary scanning direction) substantially perpendicular to the direction of arrangement of the recording elements, the entire region of the recording medium can be scanned with the recording elements to record image on the entire surface of the recording medium. As a result, printers using the line head can accomplish image recording rapidly and by simple operations without movement of the carriage and intermittent transfer of the recording medium.

On the other hand, the line head has several disadvantages such as higher cost, lower yield and reliability than the short head. In addition, if some of the recording elements break, the expensive line head has to be replaced as a unit and this results in high repair cost.

In order to solve these problems of the line head, it has been proposed that a plurality of short heads each having recording elements arranged in one direction (a main scanning direction) be arranged in the main scanning direction (see Examined Japanese Patent Publication JP, 4-038589, B) The advantages of short heads such as low cost, high yield and reliability are retained by this line head. In addition, if some recording elements break, only the short head having such broken recording elements need be replaced and this contributes to considerable economy in terms of repair cost.

On the other hand, in order to ensure that high-quality image without defects such as streaks (streaky unevenness in density or concentration) and clear spots is recorded with the line head comprising an array of short heads, the individual short heads must be positioned exactly enough to give an appropriate or equal pitch of recording elements at each of the joints between adjacent short heads. It goes without saying that the ends of adjacent two short heads which form the joint therebetween need be produced in an extremely precise manner so that the short heads can be positioned exactly.

However, the recording elements are arranged at such small intervals (e. g. on a pitch of 20 $\mu$m if the resolution is 1200 dpi) that difficulty is found in arranging many short heads in exact registration in terms of making the end of each short head which forms a joint with that of the adjacent short head, and considerable difficulty is involved in positioning.

A first object of the present invention, which solves the above-described problems of the conventional art, is to provide a line head for use in recording an image by inkjet and the like which is composed of a plurality of short heads each having recording elements arranged in one direction and capable of easily performing an arrangement or a registration of the short heads whereby a manufacturing process can be simplified and a cost reduction can be realized.

Further, a second object of the present invention is to provide an image recording method capable of recording an image of high quality without unevenness in color, density (concentration) and the like by using the above-described line head.

SUMMARY OF THE INVENTION

In order to achieve the above-described first object, the first aspect of the present invention provides a line head, comprising: a plurality of short heads, each of which has an array of recording elements arranged in one direction, disposed in the one direction of arrangement, wherein two of the plurality of short heads which are adjacent to each other in the one direction of arrangement are located at different positions from one another in an auxiliary scanning direction which is approximately or substantially perpendicular to the one direction of arrangement, and wherein an interval between a recording element of one of the two of the plurality of short heads and a recording element of the other short head, which two recording elements are adjacent to each other in the one direction of arrangement when viewed from the auxiliary scanning direction, is equal to or less than an arrangement pitch of the array of the recording elements in the two of the plurality of short heads; further comprising: a selection unit for selecting the recording elements to be used in a joint region of two of the plurality of short heads which are adjacent each other in accordance with the arrangement pitch of the array of the recording elements and the interval.

Preferably, in the line head of the first aspect, the two of the plurality of short heads which are adjacent to each other in the one direction of arrangement are located such that respective arrays of the recording elements are partly overlapped with each other when viewed from the auxiliary scanning direction.

In the case of recording one line to be recorded on a recording medium by employing a line head comprising a plurality of short heads that are arranged such that the arrays of recording elements of two of the short heads adjacent to each other are partly overlapped with each other as above, it is preferable to shift recording timings by a period of time which is determined depending on the distance in the auxiliary scanning direction between recording elements of two short heads adjacent to each other as well as the auxiliary scanning speed so that arrays of recording elements of a plurality of short heads ray effect recording in one and the same line to be recorded.

Preferably, each of the plurality of short heads comprises a plurality of rows of arrays of the recording elements in the auxiliary scanning direction.

Preferably, a plurality of head units in each of which the plurality of short heads are arranged in the one direction of arrangement are arranged in the auxiliary scanning direction.

In order to achieve the above-described second object, the second aspect of the present invention provides a method of recording an image on a recording medium employing a line head, the line head comprising a plurality of short heads, each of which has an array of recording elements arranged in one direction, disposed in the one direction of arrangement, wherein two of the plurality of short heads which are adjacent to each other in the one direction of arrangement are located at different positions from one another in an auxiliary scanning direction which is approximately or substantially perpendicular to the one direction of arrangement, and wherein an interval between a recording element of one of the two of the plurality of short heads and a recording element of the other short head, which two recording elements are adjacent to each other in the one direction of arrangement when viewed from the auxiliary scanning direction, is equal to or less than an arrangement pitch of the array of the Recording elements in the two of the plurality of short heads, comprising the steps of: moving relatively the line head and the recording medium in the auxiliary scanning direction; and driving the recording elements while controlling the driving each of the recording elements in a joint region of two of the plurality of short heads which are adjacent to each other in the line head in accordance with the arrangement pitch of the array of the recording elements and the interval.

Preferably, the driving step comprises the step of: controlling the driving of the recording elements of at least one of the two of the plurality of short heads in the joint region in accordance with the interval such that unevenness in density caused by a difference between the interval and the arrangement pitch of the recording elements is corrected.

Preferably, the driving step further comprises the steps of: determining a position of a join, at which the driving of respective recording elements of each of the two of the plurality of short heads which are adjacent to each other is switched from one short head to the other short head, between the recording element of the one short head and he recording element of the other short head, which the two recording elements are adjacent to each other in the one direction of arrangement; controlling the driving of the recording elements of at least one of the short heads in accordance with the interval in the position of the joint such that the unevenness in density caused by a difference between the interval and the arrangement pitch of the recording elements is corrected.

Preferably, the driving step comprises the step of: stopping use of the recording element which exists in a side of an end of each of the two of the plurality of short heads from the recording element of the one short head or the recording element of the other short head, the latter two recording elements being adjacent to each other in the one direction of arrangement and determining the position of the joint.

Preferably, the position of the joint is changed while the image is recorded.

Preferably, when each of the plurality of short heads has a plurality of rows of arrays of the recording elements in the auxiliary scanning direction, the position of the joint is changed based on an array of the recording elements.

Preferably, when each of the plurality of short heads has a plurality of rows of arrays of the recording elements in the auxiliary scanning direction, the position of the joint is changed in accordance with recording timing of the recording elements.

Preferably, the controlling of the driving of the recording elements is performed by at least one method selected from the group consisting of: control of recording dot density, control of recording density and control of an area of one recording dot.

That is, it is preferable to control the drive of the recording elements by controlling at least one of a recording dot (or pixel) density, a recording (color) density (concentration), and the area of one recording dot.

Preferably, the two of the plurality of short heads which are adjacent to each other in the one direction of arrangement are located such that respective arrays of the recording elements are partly overlapped with each other when viewed from the auxiliary scanning direction.

Preferably, each of the plurality of short heads comprises a plurality of rows of arrays of the recording elements in the auxiliary scanning direction.

Preferably, a plurality of head units in each of which the plurality of short heads are arranged in the one direction of arrangement are arranged in the auxiliary scanning direction.

Preferably, the line head further comprises a selection unit for selecting the recording elements to be used in a joint region of the two of the plurality of short heads which are adjacent each other in accordance with the arrangement pitch and the interval; wherein the driving of the selected recording elements is controlled.

BRIEF DESCRIPTION OF THE DRAWINGS

FIGS. 1A and 1B show an embodiment of an inkjet printer making use of the present invention, wherein FIG. 1A is a schematic front elevational view of the inkjet printer; and FIG. 1B is a partial perspective view of the same inkjet printer;

FIG. 2 is a view conceptually showing a part of an embodiment of a recording head used in the inkjet printer shown in FIG. 1;

FIG. 3A is a conceptual view showing a part of the recording head shown in FIG. 2;

FIG. 3B is a conceptual view explaining an example of conventional image recording methods;

FIGS. 3C and 3D are conceptual views each explaining an example of the image recording method of the present invention;

FIGS. 11A, 113 and 11C are conceptual views each explaining another embodiment of the color image recording method of the present invention;

DETAILED DESCRIPTION OF THE INVENTION

A line head of a first aspect of the present invention and an image recording method using the line head of a second aspect of the present invention will be described below in detail with reference to the preferred embodiments shown in the accompanying drawings.

Figure 1A:
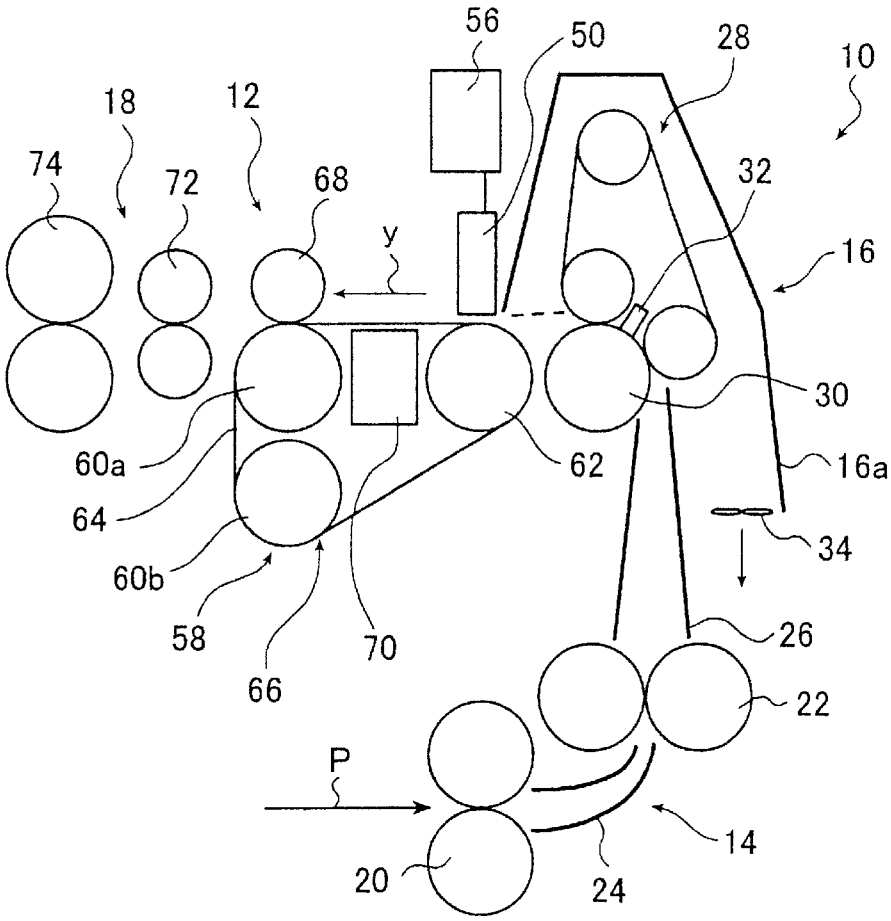
Figure 1B:
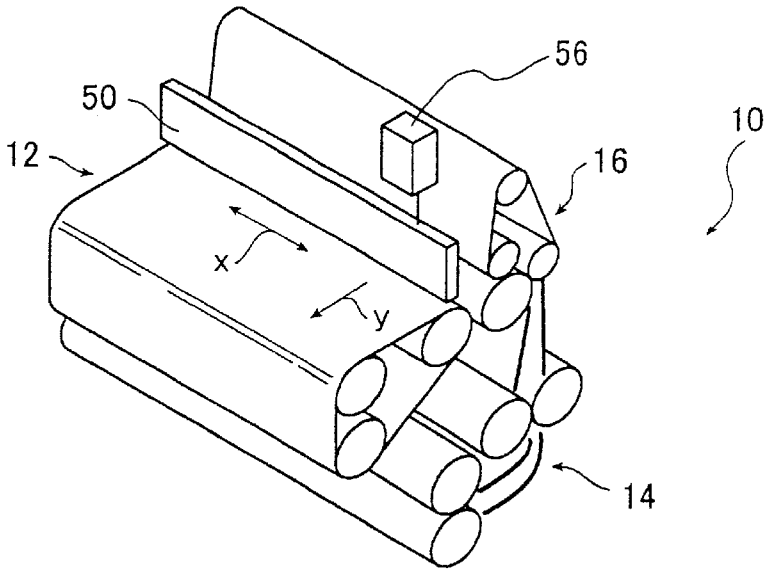

FIGS. 1A and 1B show an embodiment of an inkjet printer which implements the image recording method of the second aspect of the present invention using the line head of the first aspect of the present invention, wherein FIG. 1A is a schematic front elevational view (view observed from a main scanning direction) conceptually showing the arrangement of the inkjet printer, and FIG. 1B is a conceptual view when the inkjet printer is observed from an oblique direction.

The applicability of the present invention is by no means limited to the inkjet printer and is equally applicable with advantage to various modes of image recording (image recording apparatus ) such as a dot impact printer, a thermal printer, and sublimation printer that employ a recording head including a unidirectional array of recording elements.

The inkjet printer (hereinafter referred to simply as 'printer') 10 shown in FIG. 1 employs an inkjet recording head (hereinafter referred to simply as 'recording head') 50 which is a so-called line head having ink propelling nozzles (recording elements) 52 (as shown in FIG. 2) arranged over a distance beyond the length of at least one side of a recording medium P having a maximum size that can be handled. The printer 10 is essentially the same as a known inkjet printer except that the recording head 50 is a line head of the first aspect of the present invention comprising an array of short heads 54 (as shown in FIG. 2) and that it implements the image recording method of the second aspect of the present invention.

The printer 10 shown in FIG. 1 includes a recording section 12 for recording an image by executing the image recording method of the second aspect of the present invention by the recording head 50 acting as the line head of the first aspect of the present invention, a feed section 14, a preheat section 16, and an ejecting section 18 (omitted in FIG. 1B).

Needless to say, the printer 10 may further include various known members and units that are installed in various types of inkjet printers, as exemplified by a maintenance unit primarily intended to clean the recording head 50 and the cap (lid) of the recording head 50 for preventing the drying and clogging of nozzles 52.

The feed section 14 has transport roller pairs 20 and 22, as well as guides 24 and 26. The recording medium P such as recording paper is first fed laterally into the feed section 14, through which it is transported upwardly to enter the preheat section 16.

The preheat section 16 has a conveyor 28 consisting of three rollers and an endless belt, a pressure roller 30 that is positioned outside the conveyor 28 and which is inwardly pressed against the endless belt, a heater 32 that is positioned inside the conveyor 28 and which is pressed outwardly against the pressure roller 30, and an evacuation fan 34 for evacuating the interior of the preheat section 16 (its housing 16*a*).

The purpose of the preheat section 16 is to heat the recording medium P prior to inkjet image recording so that ink propelled onto the recording medium P can be dried (fixed) at accelerated rate. The recording medium p emerging from the feed section 14 enters the preheat section 16, through which it is transported as it is held between the conveyor 28 and the pressure roller 30 and its recording surface is heated with the heater 32 before transport into the recording section 12.

The recording section 12 includes the recording head 50, a recording control section 56 and a recording medium transport device 58 and it is used to implement the image recording method of the invention. The recording head 50 is loaded with ink tanks (not shown).

As already mentioned, the recording head 50 is a so-called line head in which the ink propelling nozzles 52 are arranged beyond the length of at least one side of the recording medium P having the maximum size that can be handled by the printer 10. In FIG. 1A, the direction of arrangement of the nozzles 52 (which is hereinafter referred to as the main scanning direction) is normal to the surface of the paper.

Hence, the recording head 50 is such that by making relative movement of the recording head 50 and the recording medium P once in the auxiliary scanning direction which is substantially normal (approximatelly perpendicular or perfectly perpendicular) to the main scanning direction, namely, by performing one scan, image can be recorded on the entire surface of the recording medium P. In the illustrated case, image is recorded on the recording medium e as it is transported in the auxiliary scanning direction indicated by an arrow y.

In the printer 10 to which the invention is applied, the recording head 50 is not a single long inkjet (recording) head but a long recording head 50 in which a plurality of short inkjet heads (short heads 54) are arranged in the main scanning direction.

FIG. 2 shows in conceptual form a plane of a path of the recording head 50 to which the present invention is applied (seen from the nozzles 52).

In the present embodiment, for clarity of the constitution of the invention and the explanation to be given later of the image recording method of the second aspect of the invention, it is assumed that the recording head 50 (constituted of short heads 54) has a single array of nozzles 52 and is adapted to the recording of a monochromatic image.

However, the present invention is by no means limited to this particular case and the recording head 50 may be adapted to the recording of a color image by providing the short heads with four nozzle arrays, one for propelling K (black) ink, another for M (magenta) ink, yet another for C (cyan) ink and the last for Y (yellow) ink, or more than four nozzle arrays further including those for light C and light M inks. Embodiments thereof will be described in pages that follow. Alternatively, the recording head 50 of the type shown in FIG. 2 is taken as one head unit and a plurality of head units may be arranged in the auxiliary scanning direction to allow the color image to be recorded.

As shown in FIG. 2, the recording head 50 acting as the line head of the first aspect of the present invention constitutes the line head by arranging the plurality of short heads 54 in the main scanning direction. Further, in the recording head 50 of the present invention, the short heads 54 that are adjacent to each other (two adjacent short heads) in the main scanning direction are located at different positions from one another and arranged such that, when viewed from the auxiliary scanning direction, an interval formed by respective arrays of the nozzles of short heads is equal to or less than a predetermined nozzle (nozzle arrangement) pitch (hereinafter referred to as "appropriated nozzle pitch" or "reference nozzle pitch"). It is preferable that the short heads 54 that are adjacent to each other in the main scanning direction be disposed such that the arrays of the nozzles overlap (this state will be expressed as "overlapping in auxiliary scanning direction") when viewed from the auxiliary scanning direction.

Further, as a preferable mode of the recording head 50 of the illustrated example, the short heads 54 are alternatively disposed, that is, staggered in the auxiliary scanning direction. With this arrangement, the positional offset of the respective short heads 54 can be minimized.

As is well known, a line head having nozzles arranged over the enter length of a recording medium has the advantage that there is no need to move the inkjet head by means of a carriage as in the conventional inkjet recording apparatus but that a single scan with the line head is sufficient to record image in the entire area of the recording medium P.

However, a single long line head capable of image recording over the entire length of the shorter side of size A4 is very difficult to fabricate and its production is not only costly but also low in yield.

On the other hand, a long line head can be fabricated making use of a conventionally manufactured inkjet head by arranging a plurality of the short heads 54 in the main scanning direction as in the present invention.

Ordinarily, to manufacture the line head using the plurality of short heads 54, it is necessary that the respective short heads 54 be arranged in exact registration at a proper pitch (for example, 20 $\mu$m pitch in 1200 dpi). In the recording head 50 of the present invention, however, such exact registration is not necessary, and it is sufficient to arrange the short heads 54 that are are adjacent to each other in the main scanning direction at a different position in the auxiliary scanning direction with the intervals between the arrays of the nozzles thereof set equal to or less than the proper nozzle pitch. In this case, it is preferable that the arrays of the nozzles overlap in the auxiliary scanning direction.

Further, since the intervals of the arrays of the nozzles are set equal to or less than nozzle pitch, no nozzle 52 is omitted when the overall arrays of the nozzles of the recording head 50 are observed. Thus, deterioration of image quality such as a white line extending in the auxiliary scanning direction, and the like which is caused by the omission of the nozzle 52 can be prevented.

As a result, the recording head according to the ta g present invention can be manufactured by a simple manufacturing process in high yield, and thus the recording ahead is very advantageous in productivity, cost, yield and the like. Note that the error of image concentration caused by the offset of the respective short heads 54 in the auxiliary scanning direction can be easily corrected by the delay of an image signal, and the like.

In a joint region of short heads 54 in the recording head 50 of the present invention, however, the intervals of the nozzles are shorter than the proper nozzle pitch or a region is made in which the nozzles 52 (the arrays of the nozzles 52) overlap in the auxiliary scanning direction in two short heads 54. That is, nozzles 52 are excessively packed in a joint region when viewed from the overall arrays of the nozzles of the recording head 50.

Accordingly, when an image is ordinarily recorded with this recording head 50, there is caused a high density (concentration) region, which extends in the auxiliary scanning direction in a joint region, which makes it difficult to record an image of high quality.

In contrast, an image of high quality without unevenness in color and density (concentration) can be recorded by utilizing the image recording method of the second aspect of the present invention while making full use of the characteristics of the recording head 50 (line head) of the present invention. This point will be described later.

It should be noted that the joint region in the present invention means a region which includes the nozzles 52 (recording elements) that are nearest to each other when the arrays of the nozzles in adjacent short heads 54 do not overlap in the auxiliary scanning direction, thus the joint region corresponds to a position of joint which will be described later. Further, when the arrays of the nozzles overlap in the auxiliary scanning direction, the joint region means the overlapping region.

In the present invention, the short heads 54 may employ a variety of known inkjet heads, including a top shooter head (face inkjet head), a side shooter head (edge inkjet head), a thermal inkjet head which propels ink upon heating. Also useful are inkjet heads which use a piezoelectric device, static electricity and so forth to vibrate a diaphragm so as to produce a sufficient force to propel ink.

The thermal inkjet heads described in detail in JP, 06-071888, A, JP, 06-0297714, A, JP, 07-227967, A, JP,08-

020110, A, JP, 08-207291, A, and JP, 10-016242, A, are used with particular advantage. In these inkjet heads, a drive LSI (Large Scale Integrated) circuit for applying electric pulses and a thin-film heater for heating and propelling ink are formed on the same silicon (Si) substrate and this has lead to the accomplishment of heretofore unattainable compactness, high thermal efficiency and durability. In addition, using the semiconductor fabrication technology, the inkjet heads can be manufactured in the same manner as Si chips, so the products have very high precision and feature good productivity.

The recording control section 56 is connected to the recording head 50. The drive of the respective nozzles 52 when an image is recorded, that is, the propulsion of ink from the respective nozzles 52 is controlled by the recording control section 56. That is, the recording control section 56 causes the recording head 50 to execute the image recording method of the present invention.

The recording control section 56 controls the respective nozzles 52 of the respective short heads 54 of the recording head 50 such that the image recording method of the present invention is executed. In the case of recording one line to be recorded on the recording medium P by employing a line head which comprises short heads 54 arranged in a staggered manner, such as the recording head 50 in the illustrated example, such control is of cource carried out that timings for driving arrays of nozzles 52 of respective short heads 54, namely recording timings, are shifted by a period of time which is determined depending on the distance in the auxiliary scanning direction (positional offset) between the nozzles 52 of two short heads 54 adjacent to each other as well as the auxiliary scanning speed so that arrays of nozzles 52 of a plurality of short heads 54 may effect recording in one and the same line to be recorded, as is the case with conventional line heads.

The recording medium transport device 58 comprises: a conveyor 66 consisting of rollers 60*a*, 60*b* and a suction roller 62, as well as a perforated endless belt 64; a nip roller 68 (omitted from FIG. 15) that is pressed against the roller 60*a* through the perforated endless belt 64; and a suction box 70 provided within the space defined by the conveyor 66.

The recording head 50 is positioned in such a way that the nozzles 52 are arranged in the main scanning direction which is substantially normal to the surface of the paper on which FIG. 1A is drawn whereas the nozzles 52 themselves are directed toward the suction roller 62. The recording medium transport device 58 transports the recording medium P continuously at a specified speed in the auxiliary scanning direction (indicated by the arrow Y) which is perpendicular to the main scanning direction of the recording head 50. Hence, the recording medium P supplied from the preheat section 16 is scanned over the entire surface by the recording head 50 (line head) as image is recorded with the ink being propelled from the nozzles 52.

The conveyor 66 which is composed of the perforated endless belt 64 surrounds the suction roller 62 and the suction box 70. Hence, the recording medium P is transported as it is sucked onto the perforated endless belt 64 and image is recorded as it is held in an appropriate specified position relative to the recording head 50.

After image recording, the recording medium P is supplied to the ejecting section 18, where it is transported by transport roller pairs 72 and 74 to be ejected, for example, into an ejector tray (not shown).

Since the recording head 50 of the illustrated example is the line head composed the short heads 54 arranged as described above, the short heads 54 need not be subjected to registration and the like according the proper nozzle pitch, and it is sufficient to arrange the short heads so that the intervals between the arrays of the nozzles of the short heads 54 that are adjacent to each other are equal to or less than the proper nozzle pitch and that the arrays of the nozzles preferably overlap in the auxiliary scanning direction.

However, as described above, nozzles are excessively packed in a joint region. Accordingly, when an image is ordinarily recorded, a high (dot or color) density region that extends in the auxiliary scanning direction is made in a joint region as shown by, for example, a region a of FIG. 3B, whereby an image of high quality cannot be obtained, Note that FIGS. 3B to 3D each show an example in which an overall-printed image is recorded and white circles show ink dots partitioned by droplets of ink propelled from one of the nozzle 52.

In contrast, the execution of the image recording method of the second aspect of the present invention for controlling the drive of the respective nozzles 52 (recording elements) according to the intervals of the nozzles 52 between both short heads 54 in a joint region overcomes this disadvantage, whereby an image of high quality can be recorded by means of the recording head 50 of the present invention.

In the illustrated example, as a preferable mode, drive of the nozzle 52 of at least one of the short heads 54 in controlled such that unevenness of density (concentration) caused by a difference between an interval between the nozzle 52 of both short heads 54 and a nozzle arrangement pitch is corrected in accordance with this interval in the joint region.

For example, in the illustrated example, as a more preferable mode, in the joint region, the position of joint for changing the arrays of the nozzles of two short heads 54 which are adjacent to each other, namely, for changing from one array (shown in upper side in FIG. 3) corresponding to one of the short heads 54 to the other array (shown in lower side in FIG. 3) corresponding to the other short head 54 is determined, that is, in the illustrated example, the position of joint is determined in a nozzle 52 of one of two short heads 54 adjacent to each other and a nozzle 52 of the other short head 54, which two nozzles are adjacent to each other in a main scanning direction (in a direction of arrangement of nozzle array),and then, drive of the nozzles 52 in this position of joint and in a vicinity thereof and further, preferably, two nozzles 52 which determine this position of joint is controlled such that unevenness of density caused by a difference between an appropriate nozzle pitch and an interval between nozzles 52 in this position of joint is corrected in accordance with this interval.

On this occasion, it is preferable to stop using a nozzle of each short head which is located in an end side of the short head from the position of joint.

Examples of the above arrangement will be described with Reference to FIGS. 3A to 3D and the like.

In the example shown in FIG. 3A, the arrays of the nozzles of short heads 54A and 54B which are adjacent to each other overlap in the auxiliary scanning direction, and the joint region thereof includes nozzles 52A-1 to 52A-3 on the short head 54A side and nozzles 52B-1 to 52B-3 on the short head 54B side.

In accordance with the above arrangement, the recording control section 56 determines that the position of joint where the arrays of the nozzles are switched between the short head 54A and the short head 54B is the nozzle 52A-2 of the short head 54A and the nozzle 52B-2 of the short head 54B as shown by dot-dash-lines, and it is stopped to use the nozzle 52A-1 on the short head 54A and the nozzle 52B-1 on the short head 54B which are located on end sides of respective short heads 54 than the nozzles 52A-2 and 52B-2, respectively.

Further, a density (concentration) at the position of joint is higher than a proper value because the interval between the nozzles 52A-2 and 52B-2 acting as the position of joint is narrower than the proper nozzle pitch. To correct the high density, the recording control section 56 stops driving one of the nozzles every other line in the auxiliary scanning direction so as to record an image with a proper density (concentration).

In a region b of FIG. 3C, the drive of the nozzle 52B-2 of the short head 54B is stopped every two lines in the auxiliary scanning direction. Note that a nozzle the drive of which is stopped is by no means limited to the nozzle 52, which is located at the position of joint, of the short head 54 on the one side, and the drives of the nozzles 52A-2 and 52B-2 at the position of joint may be alternately stopped every two lines as shown in a region c of FIG. 3D.

The pattern of drive of the nozzles (recording elements) at the position of joint is not limited to the above one in which the drive of any one of the two nozzles is stopped every other line.

Figure 4A:
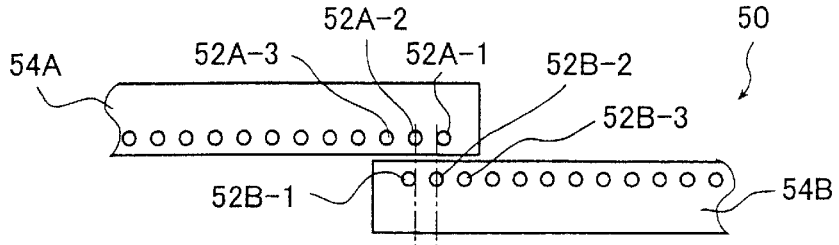
FIG. 4A is a conceptual view showing a part of an example of the recording head of the present invention.
Figure 4B:
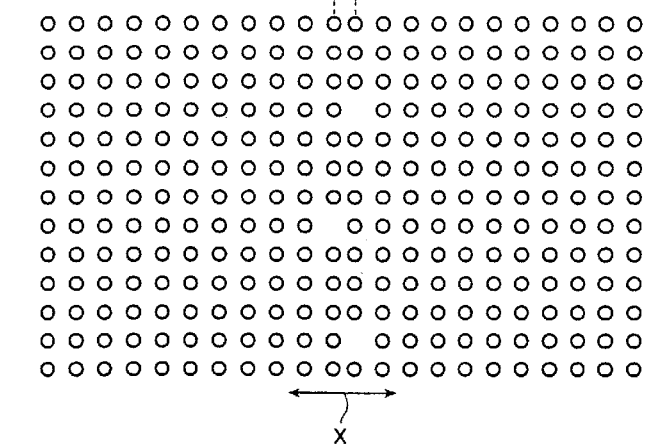
FIG. 4B is a conceptual view explaining another example of the image recording method of the present invention.
Figure 5A:
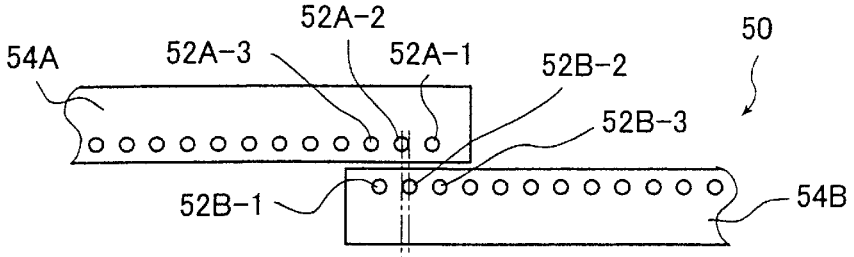
FIG. 5A is a conceptual view showing a part of another example of the recording head of the present invention.
Figure 5B:
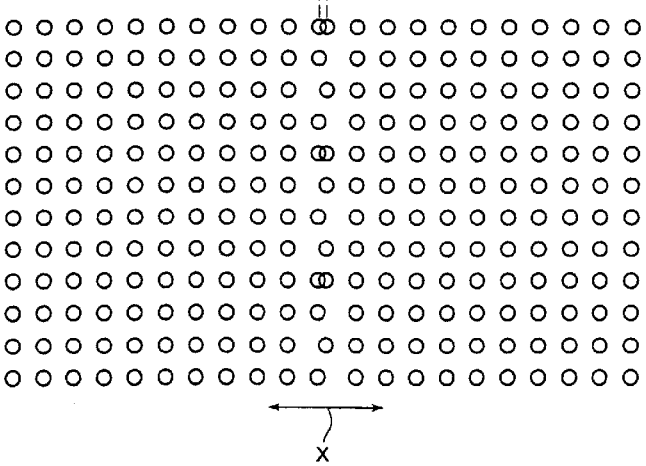
FIG. 5B is a conceptual view explaining still another example of the image recording method of the present invention.

For example, in a case in which a joint region and a position of joint which are similar to the above ones are provided as shown in FIG. 4A, when the interval between two nozzles 52 at the position of joint are nearer to the proper nozzle pitch, the drive of any one of the nozzles 52A-2 and 52B-2 may be stopped every four lines (they are alternately stopped in the illustrated example), as shown in FIG. 4B. Further, in a similar case as shown in FIG. 5A, when the nozzles 52 at the position of joint have a shorter interval, recording may be executed by driving both the nozzles 52 at the position of joint every four lines and by alternately driving the nozzles 52 at a time other than the above, as shown in FIG. 5B.

Further, the drive of the nozzles other than those located at the predetermined position of joint may be controlled in the joint region.

Figure 6A:
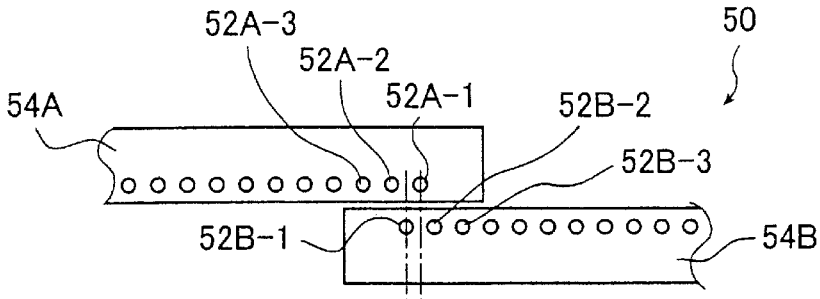
FIG. 6A is a conceptual view showing a part of another example of the recording head of the present invention.
Figure 6B:
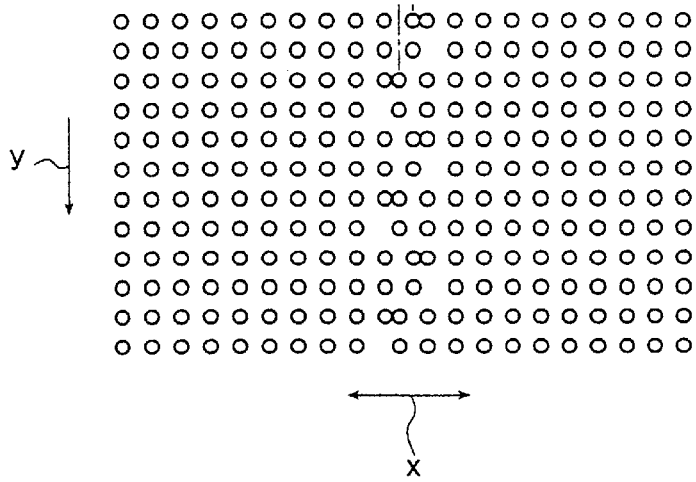
FIG. 6B is a conceptual view explaining a further example of the image recording method of the present invention.

FIGS. 6A and 6B show an example of the based on case. In this example, as shown in FIG. 6A, a joint region includes the nozzles 52A-1 and 52A-2 of the short head 54A and the nozzles 52B-1 and 52B-2 of the short head 54B which overlap in the auxiliary scanning direction, and the nozzles 52A-1 and 52B-1 are located at the predetermined position of joint. In fact, nozzles 52, which practically effect the joint between the short heads 54A and 54B and consequently provide the practical position of joint, are in two pairs, that is to say, the nozzles 52A-1 and 52B-2 and the nozzles 52A-2 and 52B-1. In the illustrated example, as shown in FIG. 6B, the nozzles 52A-1 and 52B-1 are alternately driven every two lines at the predetermined position of joint as well as the drive of the nozzles 52A-2 and 52B-2 in the joint region other than the predetermined position of joint is alternately stopped every four lines. In other words, the practical position of joint is switched over every two lines, and on recording of one of such two lines, drive of one of two nozzles in the practical position of joint (the nozzle 52A-2 or 52B-2 in the illustrated example) is stopped.

Figure 7A:
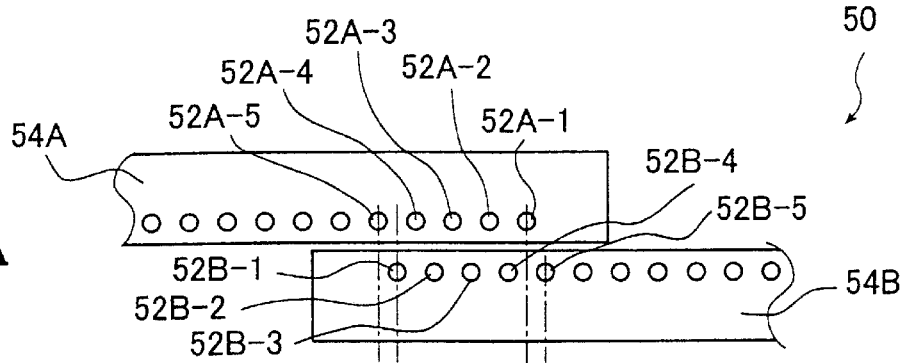
FIG. 7A is a conceptual view showing a part of another example of the recording head of the present invention.
Figure 7B:
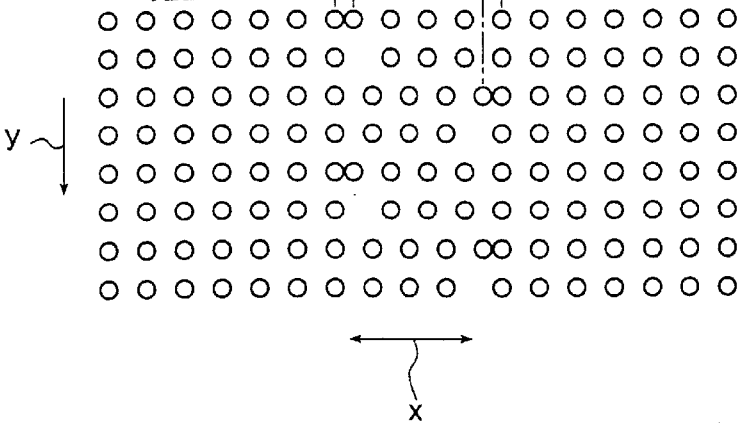
FIG. 7B is a conceptual view explaining a still further example of the Image recording method of the present invention.

Further, the position of joint may be changed regularly or irregularly while one image is recorded. This arrangement is preferable because it can make unevenness in density more inconspicuous. FIGS. 7A and 7B show an example of this case.

In the illustrated example, as shown in FIG. 7A, a joint region includes the nozzles 52A-1 to 52A-5 of the short head 54A and the nozzles 52B-1 to 52B-5 of the short head 54B which overlap in the auxiliary scanning direction.

In this example, as shown in FIG. 7B, the two points, that is, the nozzles 52A-1 and 52B-5 as well as the nozzles 52A-5 and 52B-1 are set as positions of joint, and each of the positions of joint is used every two lines.

That is, the position of joint is set to the nozzles 52A-1 and 52B-t for the first two lines (the lowermost two lines in the figure), and it is prohibited to use the nozzles 52B-1 to 52B-4 of the short head 54B which are located on the short head 54A side (namely, on the end side of the short head 54B) than the position of joint. Further, the drive of the nozzle 52A-1 is stopped at the position of joint every other line.

The position of joint is set to the nozzles 52A-5 and 52B-1 for the subsequent two lines (the third and fourth lines from the lowermost line), and it is prohibited to use the nozzles 52A-1 to 52A-4 of the short head 54A which are located on the short head 543 side (namely, on the end side of the short head 54A) than the position of joint. Further, the drive of the nozzle 52B-1 is stopped every other line at the position of joint, and thereafter recording is executed in the same manner by alternately changing the position of joint every two lines.

It is sufficient to suitably determine the drive pattern of the nozzles (recording elements) at the position of joint and in the joint region according to the interval between the nozzles 52 (the interval between the nozzle 52A-2 and the nozzle 52B-2 in cases of illustrations shown in FIGS. 3 to 5), the property of ink, matching between the ink and a recording medium, and the like. Otherwise, overall-printed images, for example, may actually be recorded using various types of drive patterns of the nozzles 52 and a drive pattern by which an overall-printed pattern having the most even density can be obtained may be employed.

Further, it is possible to arrange the relationship between the intervals, which are located between the nozzles 52 at a position of joint, and the drive patterns of the nozzles 52 as a table and to set the table to the recording control section 56 or the like; to mount a memory, in which positions of joint and the intervals between the nozzles at the positions of joint are stored, on the recording head 50; to read the memory by the recording control section 56 at that time the recording head 50 is mounted on the printer 10; to determine nozzles 52 which are not to be used; and to set a drive pattern of the nozzles 52 located at each position of joint with reference to the table.

Further, when necessary, a coefficient of correction may be determined according to the thus determined drive pattern and the Like to correct image data, and the image recording method of the present invention may be executed after the image data is corrected using the coefficient of correction.

The above example is described as to the example in which an image is recorded by inkjet that employs area modulation (modulation made by the recording dot density of an ink dot) in which the density (concentration) of one dot cannot be changed.

However, the line head, the image recording apparatus, and the image recording method of the present invention are by no means limited to the inkjet employing the area modulation and advantageously applied, in addition to it, to inkjet for recording image by density (concentration) modulation (and to the recording head of the inkjet) such as premix type inkjet for modulating a density (concentration)

by mixing a carrier and ink according to a recording density (or concentration) before propelling ink; to mist jet type inkjet for forming one dot by a multiplicity of ink mists as well as modulating a density of the one dot by an amount of ink mists; to inkjet using light and shade ink which has a plurality of densities (concentrations) by one color of light cyan, light magenta, and the like; to inkjet for changing the area of inkjet by controlling an amount of droplets of ink to be propelled; and further to inkjet which uses area modulation and density modulation together.

FIG. 8 shows an example in which the present invention is applied to the inkjet for modulating a density.

Figure 8A:
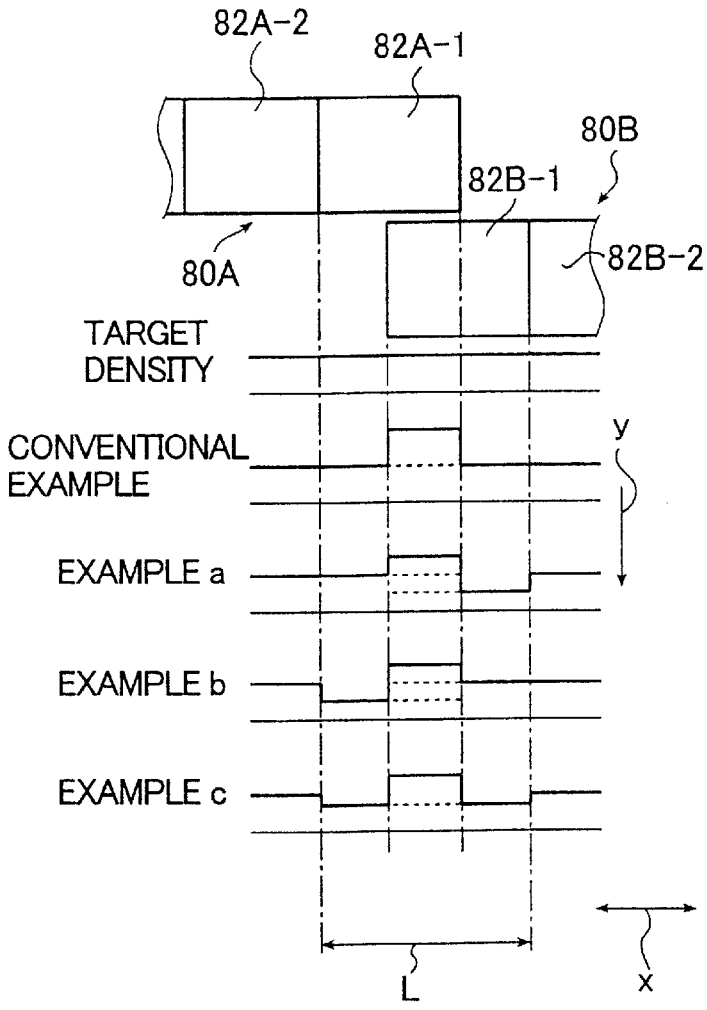
FIGS. 8A and 8B are conceptual views explaining different examples of the image recording method of the present invention, respectively.

In FIG. 8, short head 80A and 80B constituting a line head are an inkjet head for modulating the density In FIG. 8A, one nozzle (82A-1) at an end of the short head 80A overlaps one nozzle (82B-1) at an end of the short head 80B in the auxiliary scanning direction. Therefore, the nozzles 82A-1 and 82B-1 are included in a joint region and act as a position of joint. Further, the about one-half portions of both the nozzles in the recording region in the main scanning direction overlap in the auxiliary scanning direction.

When, for example, a target density (concentration) in recording is the density shown in the uppermost column in FIG. 8, if an image having the target density is recorded with the nozzles 82A-1 and 82B-1, an image the density (concentration) of which is higher by the amount of the target density is recorded in an overlapping region as shown in the column of a conventional example.

In contrast, in this example, a region L in which recording is executed by overlapped recording elements is considered as a single region and the target density is expressed in the overall region L by adjusting the recording density (concentration) of each recording element. For example, as shown in an example a, the recording element 82A-1 of the short head 80A records an image at the target density, whereas the recording head 82B-1 of the short head 80B records an image at a density one-half the target density. With this operation, while an image is recorded in the region L partly at a high density (concentration) and partly at a low density (concentration), these high and low densities are averaged in the overall region L and an image having the target density can be realized in the region L as a whole.

Otherwise, as shown in an example b, the recording element 82A-1 may record an image at the density one halt the target density and the recording element 82B-1 may record an image at the target density on the contrary so that an image is recorded in the overall region L with the overlapping recording elements 82A-1 and 82B-1 at the target density. Further, as shown in an example c, both the nozzles 82A-1 and 82B-1 execute recording at a density three fourth the target density so that image recording can be realized in the overall region L with the overlapping recording elements 82A-1 and 82B-1 at the target density.

Figure 8B:
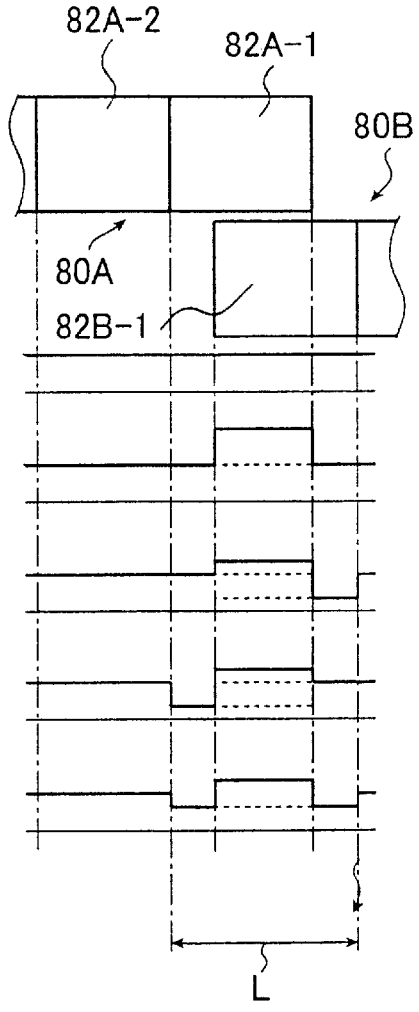

FIG. 8B shows another example. In this example, the short heads 80A and 80B have the same joint region and the same position of joint as those of FIG. 8A, and about two-third portions of the recording elements 82A-1 and 82B-1 in the recording region in the main scanning direction overlap in the auxiliary scanning direction.

Accordingly, when both the recording elements 82 record an image at the target density, an image having a high density by the target density is recorded in an overlapping region in the same way as shown in the column of the conventional example.

In contrast, for example, the recording element 82A-1 of the short head 80A records an image at the target density, whereas the recording element 82B-1 of the short head 80B records an image at a density one third the target density as shown in the example a, these densities are averaged in the overall region L and an image having the target density can be realized in the region L as a whole. Further, as shown in the example b, the recording densities employed by both the recording elements 82 may be reversed similarly to the previous example.

Otherwise, as shown in an example c, the recording elements 82A-1 and 825-1 each execute recording at a density of two-thirds the target density so that an image can be recorded in the overall region L at the target density.

The above-described embodiments are as to the recording head 50 (unit composed of an array of the short heads 54) which has an arrangement of nozzles 52 and also recording of the line image such as the characters and the like, a monochromatic image and the like using the head 50; however, the present invention is not limited to the above embodiments but may record a color image, an highly fine multi-gradation image and large area region in a same color and in a same density. On this occasion, when the color image is recorded, for example, a recording head having four nozzle arrays corresponding to ink of four colors of CMYK, or more than four nozzle arrays composed of the above four nozzle arrays and other nozzle arrays corresponding to ink of light C, light M and the like may be used. Further, when the highly fine multi-gradation image is recorded, a recording head having nozzles arrays corresponding to ink of same color but in different densities (concentrations) may be used. Still further, when the large area region of same color and density is recorded, a recording head having a plurality of nozzle arrays for propelling ink of same color and density may be used. Yet further, a recording head composed of a combination of at least two of the nozzle arrays of different colors, the nozzle arrays of different densities and the plurality of nozzle arrays of same color and density, as described above, may be used.

Figure 9:
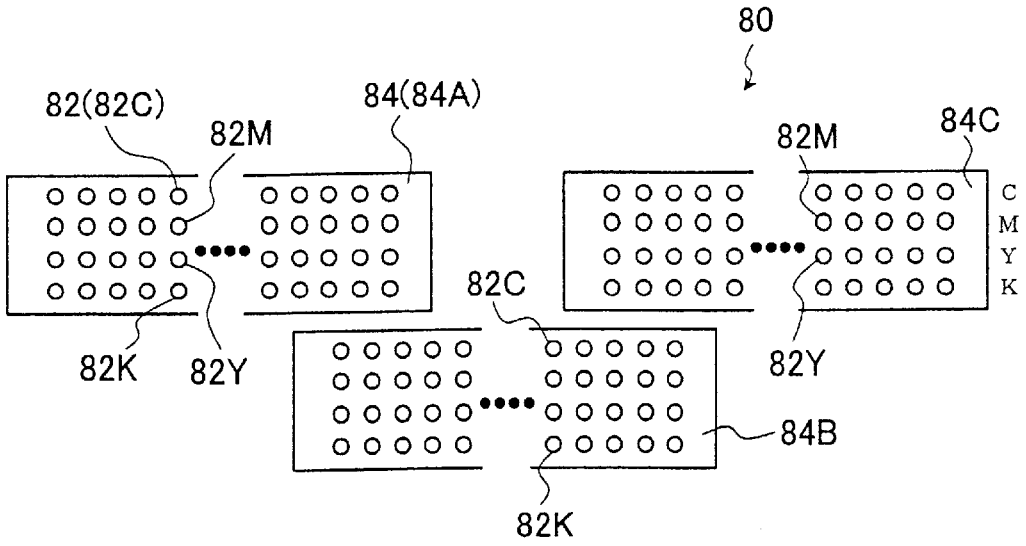
FIG. 9 is a conceptual view showing a part of another embodiment of a recording head used in the inkjet printer shown in FIG. 1.

In FIG. 9, a recording head 80 for recording a color image is shown. The recording head 80 shown in FIG. 9 is used instead of the recording head 50 for recording a color image in the printer 10 shown in FIGS. 1A and 1B and has short heads 84 (three short heads 84A, 84B and 84C are shown in an illustration) which are positioned alternately in an auxiliary scanning direction, namely, in a staggered manner.

On this occasion, respective short heads 84 (84A, 84B and 84C) have tour nozzle arrays (four row of nozzle arrays) composed of an arrangement of nozzles 82C for propelling C (cyan) ink, another arrangement of nozzles 82M for propelling M (magenta) ink, another arrangement of nozzles 82Y for propelling Y (yellow) ink and another arrangement of nozzles 82K for propelling K (black) ink.

In the recording head 80 in an illustration, respective short heads 84 (84A, 84B and 84C) are positioned such that an interval between two adjacent nozzles 82 of sane color of respective adjacent short heads 84A and 84B, and short heads 84B and 84C when observed from an auxiliary scanning direction is less than a arrangement pitch (nozzle pitch) of nozzles 82 (82C, 82M, 82Y and 82K) of respective short heads 84 (84A, 84B and 84C).

In respective short heads 84A, 84B and 84C in the illustration, a position to be formed by and an arrangement of each nozzle of nozzle arrays (82C, 82M, 82Y and 82K) for each color are same and in a same pitch among nozzles.

Figure 10A:
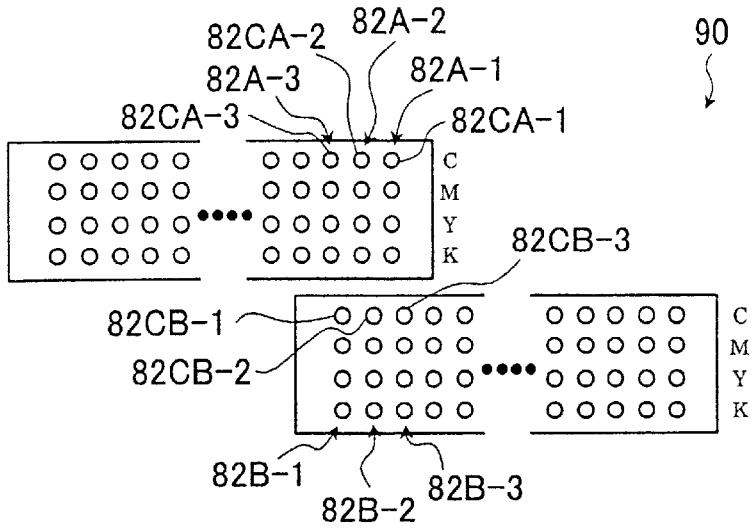
FIG. 10A is a conceptual view showing a part of recording head shown in FIG. 9 for use in a color image recording method of the present invention.

Various types of embodiments of a color image recording method in which the image recording method of the present invention is executed are explained below using the recording head 80 shown in FIG. 9 with reference to FIGS. 10 to 12.

For the purpose of simplicity of the illustration and explanation, in FIG, 10A, a case of only two short heads 84A and 84B, and only one joint region is explained. Further, in an explanation to be made below with reference to FIG. 10A, since a control of drive of the nozzle 82 of the short head 84 which is at least one of the short heads for correcting unevenness of density to be caused by a difference between an interval between two nozzles 82 for the same color of both short heads 84A and 84B and an arrangement pitch of nozzles 82 between both short heads 84A and 84B in accordance with this interval is same as in the case of monochromatic image shown in FIGS. 2 to 8, portions characteristic to the color image recording method are only explained below.

In the recording head 90 in the illustration, when the nozzle array 82C for C is represented, the joint region is between nozzles 82CA-1 and 82CA-3 on a side of the short head 84A and between nozzles 82CB-1 and 82CB-3 on a side of the short head 843.

Further, in the illustrated recording head 80, the position of joint is determined to be on the nozzle 82CA-2 of the short head 84A and the nozzle 82CB-2 of the short head 84B and then the short heads 84A and 84B are positioned such that an interval between the adjacent two nozzles 82CA-2 and 82CB-2 at the position of joint when observed from an auxiliary scanning direction (in a direction of nozzle arrangement, namely, main scanning direction) comes to be less than the arrangement pitch of nozzles 82.

Figure 10B:
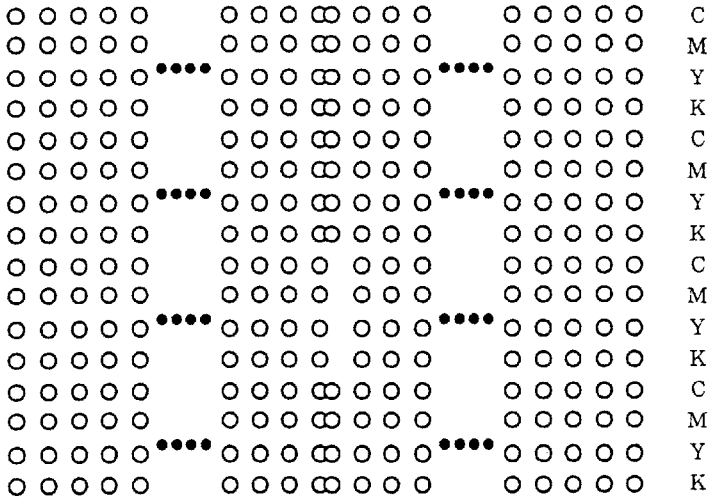
FIGS. 10B and 10C are conceptual views each explaining an embodiment of the color image recording method of the present invention.

Firstly, a first embodiment of the color image recording method of the present invention is shown in FIG. 10B.

In FIG. 10B, respective nozzle arrays (colors) 82C, 82M, 82Y and 82K join at the same position of joint (82A-2 and 82B-2) and correction timing is same among respective nozzle arrays (colors). Namely, a recording control section 56 (see FIG. 1) controls such that, in the third Line from the uppermost line of each array (color), drive of the nozzles 82B-2 (82CB-2, 82 MB-2, 82YB-2 and 82KB-2) is stopped On this occasion, particularly, since correction timing occurs at the same time in all colors, there is an effect that the color in an area of an image that corresponds to the position of joint is hardly seen changed, that is to say, unevenness in color is hardly noticed.

Figure 10C:
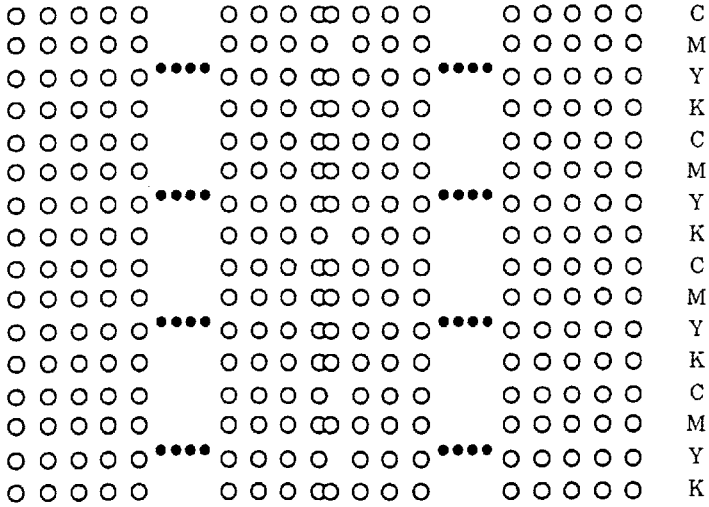

Next, a second embodiment of the color image recording method of the present invention is shown in FIG. 10C.

In FIG. 10C, respective nozzle arrays (colors) 82C, 82M, 82Y and 82K join at the same position of joint (82A-2 and 82S-2) and correction timing is shifted among nozzle arrays (colors). Namely, the recording control section 56 (see FIG. 1) controls such that drive of nozzle 82MR-2 in a first line from the uppermost line, that of nozzle 82KB-2 in a second line and that of nozzles 82CB-2 and 82YB-2 in a fourth line are stopped.

On this occasion, particularly, since correction timing is shifted from color to color and unevenness of density is dispersed, there is an effect that unevenness of density is hardly noticed.

Figure 11A:
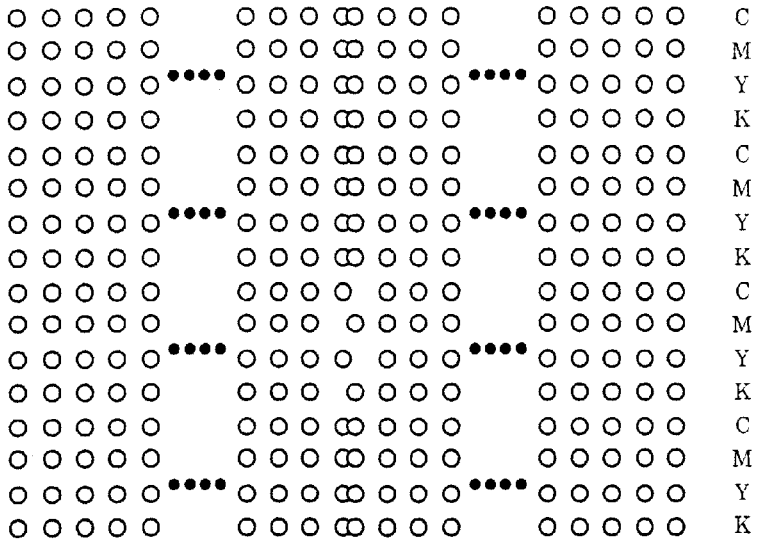
Figure 11B:
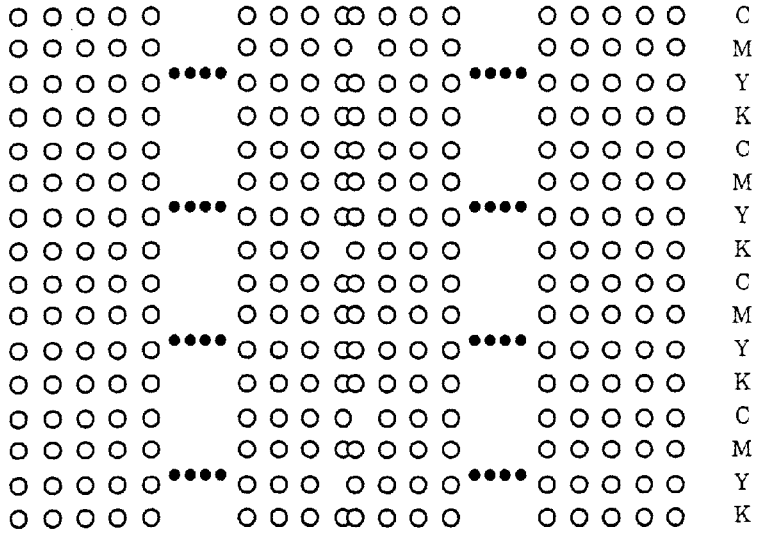

Third and fourth embodiments of the color image recording method of the present invention are shown in FIGS. 11A and 11B.

In FIGS. 11A and 11E, positions of correction nozzles of each nozzle array (color) are changed from those in FIGS. 10B and 10C. Namely, the recording control section 56 (see FIG. 1) controls such that, in FIG. 11A, in a third line from the uppermost line, with respect to C and Y, drive of the nozzles 82B-2 (82CB-2 and 82YB-2) and, with reference to M and K, that of the nozzles 82A-2 (82MA-2 and 82KA-2) are stopped and, in FIG. 11B, in first and fourth lines from the uppermost line, with reference to M and C, drive of nozzles 822-2 (82MB-2 and 82CB-2) and, in second and fourth lines, with reference to K and Y, drive of the nozzles 82A-2 (82KA-2 and 82YA-2) are stopped.

On these occasions, particularly, there is an effect that unevenness of either density or color is hardly noticed.

Figure 11C:
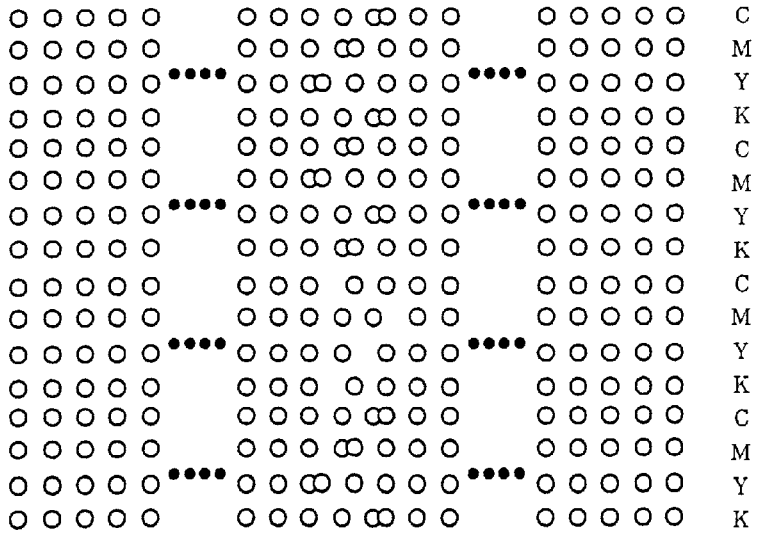
Figure 12A:
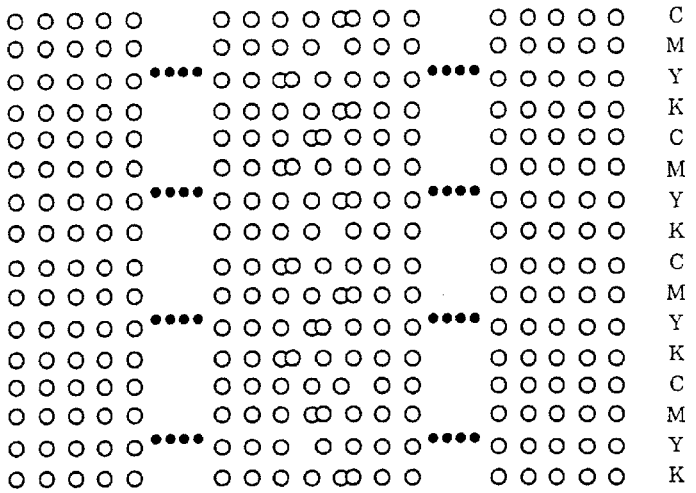
FIGS. 12A and 12B are conceptual views each explaining another embodiment of the color image recording method of the present invention.
Figure 12B:
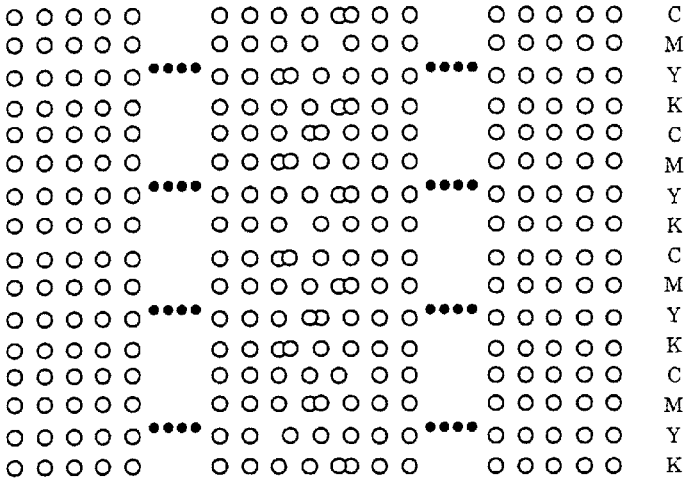

Firstly, a fifth, sixth and seventh embodiments of the color image recording method of the present invention are shown in FIG. 11C, 12A and 12B, respectively.

In FIG 1C, 11A and 12B, positions of joint are changed from those in FIG. 10B, 10C and 11B, respectively, in accordance with printing (recording) timing of each nozzle array (color). Namely, in each embodiment, the recording control section 56 (see FIG. 1) controls the correction timing or correction nozzle position by shifting the position of joint of each color nozzle array one by one such that, for example, in the first line from the uppermost line, the position of joints in color arrays of C, M, Y and K exist between nozzles 82CA-1 and 82CB-3, nozzles 82MA-2 and 82MB-2, nozzles 82YA-3 and 82YB-1, and nozzles 82KA-1 and 82KB-3, respectively, and, in the second line, the position of joints in color arrays of C and M exist between nozzles 82CA-2 and 82CB-2, and nozzles 82MA-3 and 82MB-1, respectively.

On these occasions, though the control becomes complicated, there is an effect that unevenness of either density or color becomes more hardly noticed because of the enlargement of the joint region.

In the recording head 80 shown in FIG. 9, arrangements (position to be formed, array and pitch) of nozzles in nozzle arrays 82C, 82M, 82Y and 82K for respective colors in each of the short heads 84A, 84B and 84C are same, but the present invention is not limited to the above arrangements and arrangements of nozzles may be shifted on a basis of the nozzle array of each color.

Figure 13:
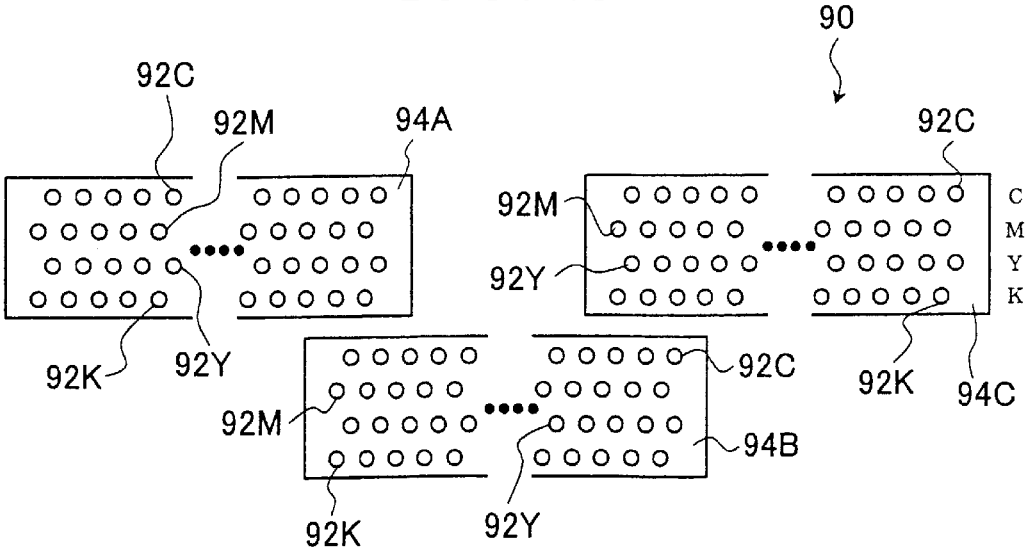
FIG. 13 is a view conceptually showing a part of another embodiment of the recording head for use in the inkjet printer shown in FIG. 1.

In FIG. 13, shown is the recording head 90 in which nozzles in nozzle arrays 92C, 92M, 92Y and 92K for respective colors in each of the short heads 94A, 94B and 94C are arranged in a staggered pattern on a basis of the nozzle array of each color. In the illustration, the nozzle arrangement pitch between any two nozzles in nozzle arrays 92C, 92M, 92Y and 92K for respective colors is same, and, further, the nozzle arrays 92C and 92Y, and nozzle arrays 92M and 92K have same nozzle arrangements, respectively.

Also in the illustrated recording head 90, the short heads 94 (94A, 948 and 94C) are arranged such that an interval between two nozzles 92 of same color, which are adjacent with each other when observed from an auxiliary direction, each in one of the adjacent two short heads 94A and 94B or 94B and 94C is less than the arrangement pitch (nozzle pitch) of the nozzles 92 (92C, 92M, 92Y and 92K).

It goes without saying that the recording head 90 may be a type of recording head having more than four nozzle arrays added with nozzles for light C, light M and the like which corresponds to recording of the color image.

Various embodiments of color image recording methods in performing an image recording method of the present invention using the recording head 90 shown in FIG. 13 is described with reference to FIG. 14 below.

Figure 14A:
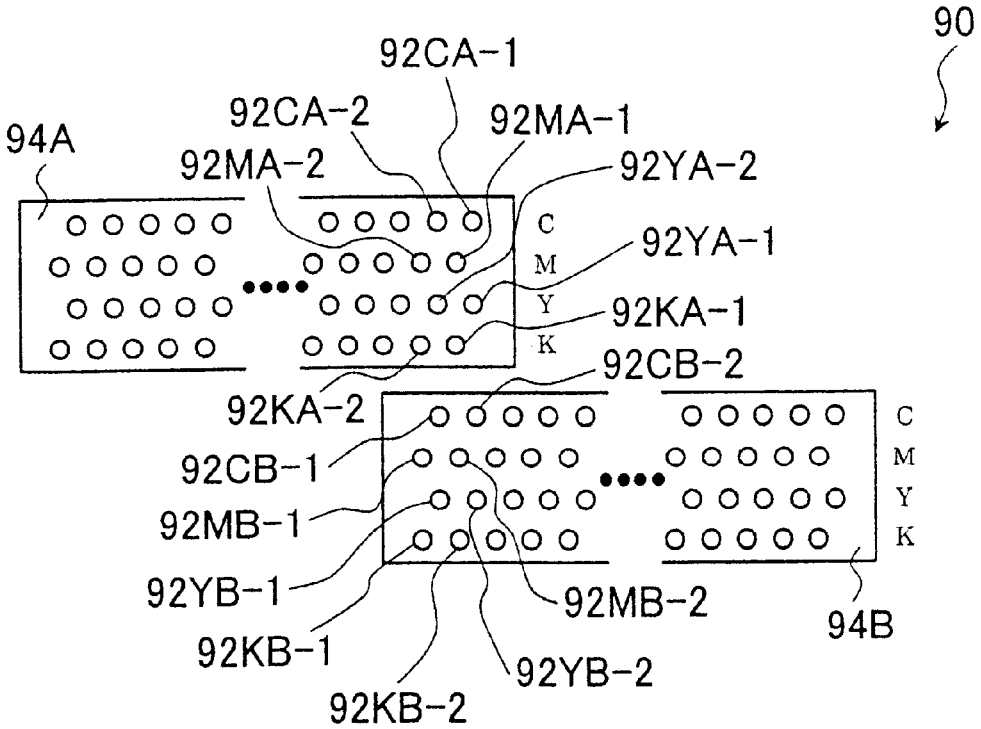
FIG. 14A is a partial conceptual view of the recording head shown in FIG. 13 for use in the color image recording method of the present invention.

For the purpose of simplicity of explanation, in FIG. 14A, the explanation is made with reference to only two short heads 94A and 948 and one joint region. In the explanation to be made below with reference to FIG. 14A, since the control of drive of the nozzle 92 of at least one of the short heads 94 for correcting the unevenness of density to be caused by a difference between an interval between two nozzles of same color in respective short heads 94A and 94B and an arrangement pitch of nozzles in the short heads 94A and 94B in accordance with the interval is performed in a similar manner to those in the first to seventh embodiments shown in FIGS. 10 to 12, only characteristic parts in he present embodiment are explained.

In the illustrated recording head 90, when the nozzle arrays 92C and 92M are represented, the joint region exists in nozzles 92CA-1, 92CA-2, 92MA-1 and 92MA-2 an a short head 94A side, and nozzles 92CB-1, 92CB-2, 92MB-1 and 92MB-2 in a short head 945 side.

Further, in the illustrated recording head 90, positions of joint are determined by the nozzles 92CA-1 (92YA-1) and 92MA-1 (92KA-1) of the short head 94A and the nozzles 92CB-2 (92YB-2) and 92MB-2 (92KB-2) of the short head 948, and the short heads 94A and 94B are arranged such that each of the intervals between two nozzles 92CA-1 and 92CB-2 and also between two nozzles 92MA-1 and 92MB-2 which are observed from an auxiliary scanning direction (nozzle arrangement direction, namely, main scanning direction) becomes less than an arrangement pitch of the nozzles 92.

Figure 14B:
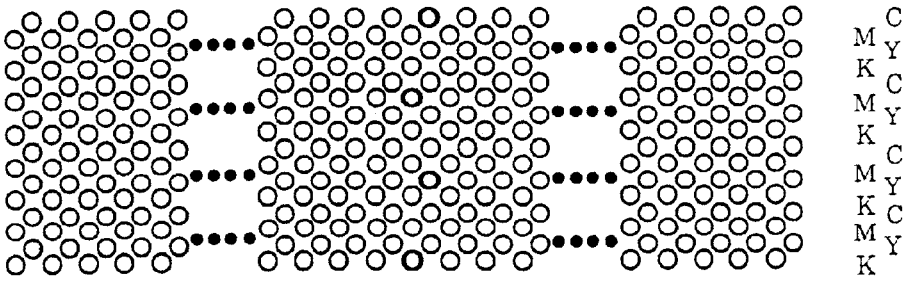
FIGS. 14B and 14C are conceptual view each explaining another embodiment of the color image recording method of the present invention.

Firstly, an eighth embodiment of the color image recording method of the present invention is shown in FIG. 14B.

In FIG. 14B, each of nozzle arrays (colors) 92C, 92M, 92Y and 92K is joined at a substantially same position (92CA-1 and 92CB-2, and 92MA-1 and 92MB-2; shifted by a staggered arrangement) and correction timing of nozzle arrays (colors) is shifted on a nozzle array basis. Namely, the recording control section 56 (see FIG. 1) controls such that, in a first line, both nozzles 92CA-1 and 92CS-2 are driven in C, one of nozzles 92A-1 and 92B-2 in each of M, Y and K is stopped while the other nozzle is driven and, in second to fourth lines, colors both nozzles of which are driven are changed to M, Y and K.

On this occasion, the position of joint is substantially same but, since nozzle arrangements of respective color arrays are staggered from one another, there is an effect that, particularly, unevenness of either density (concentration) or color is hardly noticed.

Figure 14C:
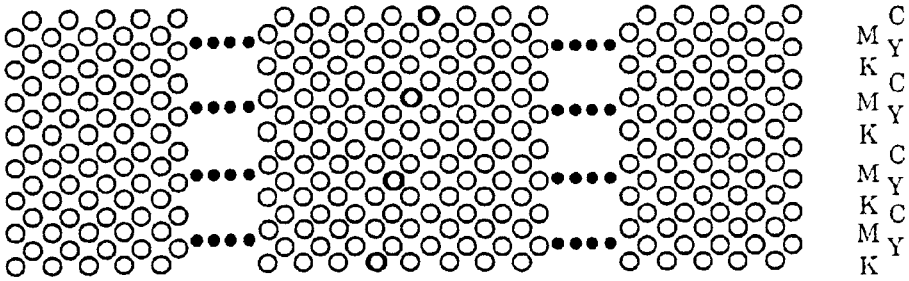

Next, the second embodiment of the color image recording method of the present invention is shown in FIG. 14C.

In FIG. 14C, each of the nozzle arrays (colors) 92C, 92M, 92Y and 92K is joined at substantially same positions of joint (92CA-1 and 92CS-2, and 92MA-1 and 92MB-2) and, by printing (recording) timing of respective nozzle arrays (colors), the substantially same positions of joint described above (in a right side of the figure) are shifted to substantially same positions of joint (92CA-2 and 92CB-1, and 92MA-2 and 92MB-1) in a left side of the figure. Namely, the recording control section 56 (see FIG. 1) controls correction timing, correction nozzle positions and the like by shifting the Positions of joint every two lines such that, in the first line, both nozzles 92CA-1 and 92CB-2 in C are driven, and one nozzle of nozzles 92(M, Y, K) A-1 and 92(M, Y, K) B-2 in any of M, Y and K is stopped while the other one is driven; in the second line, both nozzles 92MA-1 and 92MB-2 in only M are driven while one of the above-described nozzles in other colors is driven; in the third line, the position of joint is changed from nozzles 92(C, M, Y, K)A-1 and 92(C, M, Y, K)3-2 to nozzles 92(C, M, Y, K)A-2 and 92(C, M, Y, K)B-1 whereupon both nozzles 92YA-2 and 92YB-1 in only Y are driven, in the fourth line, both nozzles 92KA-2 and 92KB-1 in only K are driven while keeping the same position of Joint.

In these cases, though the control becomes complicated, joint region is enlarged and there is an effect that unevenness of either density or color is further hardly noticed.

While the line head and the image recording method of the present invention have been described above in detail, the present invention is by no means limited to the aforementioned embodiments and it goes without saying that various improvements and modifications can be made within the range which does not depart from the gist of the present invention.

As described above in detail, the head line of the present invention permits the short heads to be easily arranged, whereby a manufacturing process can be simplified and a manufacturing cost can be reduced. Further, according to the image recording method of the present invention, an image of high quality without unevenness in color, density, and the like can be recorded using the line head of the present invention having the excellent characteristics described above.

What is claimed is:

1. A line head, comprising:

a plurality of short heads, each of which has an array of recording elements arranged in one direction, disposed in said one direction of arrangement, wherein two of said plurality of short heads which are adjacent to each other in said one direction of arrangement are located at different positions from one another in an auxiliary scanning direction which is substantially perpendicular to said one direction of arrangement, and wherein an interval between a recording element of one of said two of the plurality of short heads and a recording element of the other short head, which two recording elements are adjacent to each other in said one direction of arrangement when viewed from said auxiliary scanning direction, is equal to or less than an arrangement pitch of the array of the recording elements in said two of the plurality of short heads;

further comprising:

a selection unit for selecting said recording elements to be used in a joint region of two of the plurality of short heads which are adjacent each other in accordance with said arrangement pitch of the array of the recording elements and said interval.

2. The line head according to claim 1, wherein said two of said plurality of short heads which are adjacent to each other in said one direction of arrangement are located such that respective arrays of said recording elements are partly overlapped with each other when viewed from said auxiliary scanning direction.

3. The line head according to claim 1, wherein each of said plurality of short heads comprises a plurality of rows of arrays of said recording elements in said auxiliary scanning direction.

4. The line head according to claim 1, wherein a plurality of head units in each of which said plurality of short heads are arranged in said one direction of arrangement are arranged in said auxiliary scanning direction.

5. A method of recording an image on a recording medium employing a line head, said line head comprising a plurality of short heads, each of which has an array of recording elements arranged in one direction, disposed in said one direction of arrangement, wherein two of said plurality of short heads which are adjacent to each other in said one direction of arrangement are located at different positions from one another in an auxiliary scanning direction which is substantially perpendicular to said one direction of arrangement, and wherein an interval between a recording element of one of said two of the plurality of short heads and a recording element of the other short head, which two recording elements are adjacent to each other in said one direction of arrangement when viewed from said auxiliary scanning direction, is equal to or less than an arrangement pitch of said array of the recording elements in said two of the plurality of short heads, comprising the steps of:

moving relatively said line head and said recording medium in said auxiliary scanning direction; and driving said recording elements while controlling the driving each of said recording elements in a joint region of two of said plurality of short heads which are adjacent to each other in said line head in accordance with the arrangement pitch of said array of said recording elements and said intervals.

6. The method of recording the image according to claim 5, wherein said driving step comprises the step of:

controlling the driving of said recording elements of at least one of said two of the plurality of short heads in said joint region in accordance with said interval such that unevenness in density caused by a difference between the interval and the arrangement pitch of said recording elements is corrected.

7. The method of recording the image according to claim 5, wherein said driving step further comprises the steps of:

determining a position of a joint, at which the driving of respective recording elements of each of said two of said plurality of short heads which are adjacent to each other is switched from one short head to the other short head, between said recording element of said one short head and said recording element of the other short head, which said two recording elements are adjacent to each other in said one direction of arrangement;

controlling the driving of said recording elements of at least one of said short heads in accordance with said interval in the position of the joint such that the unevenness in density caused by a difference between the interval and the arrangement pitch of said recording elements is corrected.

8. The method of recording the image according to claim 7, wherein said driving step comprises the step of:

stopping use of said recording element which exists in a side of an end of each of said two of the plurality of short heads from said recording element of said one short head or said recording element of the other short head, the latter two recording elements being adjacent to each other in said one direction of arrangement and determining said position of the joint.

9. The method of recording the image according to claim 7, wherein said position of the joint is changed while the image is recorded.

10. The method of recording the image according to claim 7, wherein, when each of said plurality of short heads has a plurality of rows of arrays of said recording elements in said auxiliary scanning direction, said position of the joint is changed based on an array of said recording elements.

11. The method of recording the image according to claim 7, wherein, when each of said plurality of short heads has a plurality of rows of arrays of said recording elements in said auxiliary scanning direction, said position of the joint is changed in accordance with recording timing of said recording elements.

12. The method of recording the image according to claim 5, wherein said controlling of the driving of said recording elements is performed by at least one method selected from the group consisting of:

control of recording dot density, control of recording density and control of an area of one recording dot.

13. The method of recording the image according to claim 5, wherein said two of said plurality of short heads which are adjacent to each other in said one direction of arrangement are located such that respective arrays of said recording elements are partly overlapped with each other when viewed from said auxiliary scanning direction.

14. The method of recording the image according to claim 5, wherein each of said plurality of short heads comprises a plurality of rows of arrays of said recording elements in said auxiliary scanning direction.

15. The method of recording the image according to claim 5, wherein a plurality of head units in each of which said plurality of short heads are arranged in said one direction of arrangement are arranged in said auxiliary scanning direction.

16. The method of recording the image according to claim 5, wherein said line head further comprises a selection unit for selecting said recording elements to be used in a joint region of said two of the plurality of short heads which are adjacent each other in accordance with said arrangement pitch and said interval;

wherein he driving of the selected recording elements is controlled.

* * * * *

UNITED STATES PATENT AND TRADEMARK OFFICE

CERTIFICATE OF CORRECTION

PATENT NO. : 6,578,950 B2
DATED : June 17, 2003
INVENTOR(S) : Nobuo Matsumoto et al.

It is certified that error appears in the above-identified patent and that said Letters Patent is hereby corrected as shown below:

Column 20,
Line 46, please replace the phrase “wherein he driving” with -- wherein the driving --.

Signed and Sealed this

Ninth Day of September, 2003

JAMES E. ROGAN
*Director of the United States Patent and Trademark Office*